US006719192B2

(12) United States Patent
Barcat et al.

(10) Patent No.: US 6,719,192 B2
(45) Date of Patent: Apr. 13, 2004

(54) BAG FOR FOOD THAT IS TO BE EATEN WITH A SAUCE

(75) Inventors: Antoine Barcat, Dijon (FR); Francoise Surivet-Cuve, Dijon (FR)

(73) Assignee: Amora Maille, Dijon (FR)

( * ) Notice: Subject to any disclaimer, the term of this patent is extended or adjusted under 35 U.S.C. 154(b) by 81 days.

(21) Appl. No.: 09/768,683

(22) Filed: Jan. 24, 2001

(65) Prior Publication Data

US 2002/0056743 A1 May 16, 2002

(30) Foreign Application Priority Data

Nov. 15, 2000 (FR) ..... 00 14833

(51) Int. Cl.[7] ..... B65D 21/024

(52) U.S. Cl. ..... 229/400; 220/23.4; 229/904; 229/906

(58) Field of Search ..... 229/400, 902, 229/904, 906; 220/23.4, 737; 206/541

(56) References Cited

U.S. PATENT DOCUMENTS

| | | | | |
|---|---|---|---|---|
| 1,762,331 A | * | 6/1930 | Greist | 220/23.4 |
| 1,801,148 A | * | 4/1931 | Gilson | 206/541 |
| 2,427,697 A | | 9/1947 | Weidler | |
| 2,582,183 A | * | 1/1952 | Weidler | 220/737 |
| 2,583,822 A | | 1/1952 | Duncan | |
| 3,128,984 A | * | 4/1964 | Palm | 220/737 |
| 5,417,364 A | | 5/1995 | Shaw | |
| 5,429,262 A | * | 7/1995 | Sharkey | 220/23.4 |
| 5,476,215 A | | 12/1995 | Baroud | |
| 5,890,648 A | | 4/1999 | Cai | |
| 6,076,700 A | * | 6/2000 | Manges | 220/23.4 |
| 6,102,208 A | | 8/2000 | Huang | |
| 6,152,362 A | * | 11/2000 | Rosenfeld | 220/737 |
| 6,193,201 B1 | * | 2/2001 | Babcock | 229/904 |
| 6,216,946 B1 | * | 4/2001 | Cai | 229/400 |
| 6,230,969 B1 | * | 5/2001 | Spransy | 229/400 |

FOREIGN PATENT DOCUMENTS

| | | |
|---|---|---|
| GB | 2297536 | 8/1996 |

OTHER PUBLICATIONS

International Search Report dated Mar. 25, 2002 in connection with international patent application No. PCT/EP01/13315.

* cited by examiner

*Primary Examiner*—Gary E. Elkins
(74) *Attorney, Agent, or Firm*—John P. White; Cooper & Dunham LLP

(57) ABSTRACT

A bag (1) for fast-food restaurants, intended to contain consumable food products, is provided. The bag (1) comprises a bottom (2) and a peripheral side envelope (3), defining an orifice (4) in its upper part. The bag includes at least one pre-shaped support (5) with an attachment element (14) to receive and support in a stable manner at least one dish (6) intended to contain an accompanying sauce for the food products placed in the bag.

9 Claims, 4 Drawing Sheets

BAG FOR FOOD THAT IS TO BE EATEN WITH A SAUCE

The present invention relates to general field of bags for fast-food restaurants, intended to contain food consumable food products like French fries, fritters, salads, fresh vegetables, or any other food intended to be consumed generally with a sauce, these food products being intended to be consumed anywhere, in general, outside the traditional places planned as classic restaurants.

The present invention concerns bag for fast-food restaurants, intended to contain consumable food productions, said bag being formed with a bottom and a peripheral side envelope defining an orifice in its upper part for the introduction of food and access thereto.

The present invention likewise concerns the set formed by a bag for fast-food restaurants of the type mentioned above, associated with a dish containing an accompanying sauce for the food products or foods placed in the bag.

In terms of the invention, we understand by "fast-food restaurant" the consumption of take-out foods in general, outside the areas of traditional restaurants that involve service to a fixed table or place.

In fast-food restaurant establishments, we already know how to provide customers with packages or bags in which the food products intended to be consumed are placed.

These packages or bags are generally made of a recyclable cardboard material and include a bottom and a peripheral side envelope defining an orifice at the upper part, by means of which the user introduces and has access to the foods stored in the bag.

These bags also permit the user to eat outside of all traditional restaurant systems, which imply eating "in place," since the food stored in the bag can be grasped directly at any place and in any environment.

This type of package also permits the user to transport the foods to be consumed to any place and in a very practical manner, which constitutes one of the basic elements of restaurants called "fast-food restaurants."

In contrast, traditional bags or packages known today do not permit a user to have the main food contained in the bag accompanied by a sauce or condiment that can be used as an accompaniment or seasoning, or permit this only with difficulty.

In fact, the absence of a support plane, such a table, makes such an operation difficult.

The packages known today only permit, as a technical solution, the sauce or condiment to be poured onto the upper part of the food contained in the bag or package.

Such a solution is not considered generally acceptable, even though it has proved to be very practicable. In fact, such a solution does not permit an optimal serving of the sauce or condiment with respect to the foods contained in the bag, causing over-servings or under-servings at points. The additional taste effect of the sauces and condiments used is therefore inoperative, at least in part.

We likewise know how to make dishes to contain sauces and condiments that can be used to accompany or season the consumable food products.

These accessories are very difficult to use within the framework of fast-food restaurants in association with a bag containing the foods that constitute the base of the meal. In fact, good use of the dishes containing the sauces or seasonings requires the environmental situation of a traditional restaurant, which implies the existence of a table or an equivalent support where the bag and the dish can be placed. In fact, it is only in such a situation that the user can grasp the food contained therein and dip it or insert it partially into the dish containing the seasoning.

The objects assigned to the invention consequently envision providing remedies to the various inconveniences enumerated previously and to propose a new bag for fast-food restaurants intended for consumable food products that permits ease of use associated with a dish containing an accompanying sauce and that is easy to manufacture and is especially simple to implement.

Another object of the invention envisions proposing a new bag for fast-food restaurants that is eventually reusable.

Another object of the invention envisions proposing a new bag for fast-food restaurants that is particularly stable during use.

Another object of the invention envisions proposing a new bag for fast-food restaurants in which it is particularly easy to place the associated dish.

Another object of the invention envisions proposing a new bag for fast-food restaurants that permits the associated dish to be supported in a particularly stable manner.

Another object of the invention envisions proposing a new set consisting of a bag conforming to the invention, associated with a dish containing an accompanying sauce.

The objects assigned to the invention are achieved by means of a bag for fast-food restaurants intended to contain consumable food products, said bag consisting of a bottom and a peripheral side envelope defining an orifice in its upper part, characterized by the fact that it includes at least one pre-shaped means of support with an attachment element to receive and support in a stable manner at least one dish intended to contain an accompanying sauce for the food products placed in the bag.

The objects assigned to the invention will be explained in more detail by reading the attached description and by the diagrams attached to the description, in a purely explanatory and non-limiting manner, in which:

FIGS. 1 through 4 show a bag 1 for fast-food restaurants, intended to contain consumable food products of the type of French fries, fritters, or other equivalent foods, generally intended to be seasoned manually by the user.

Figure 1:
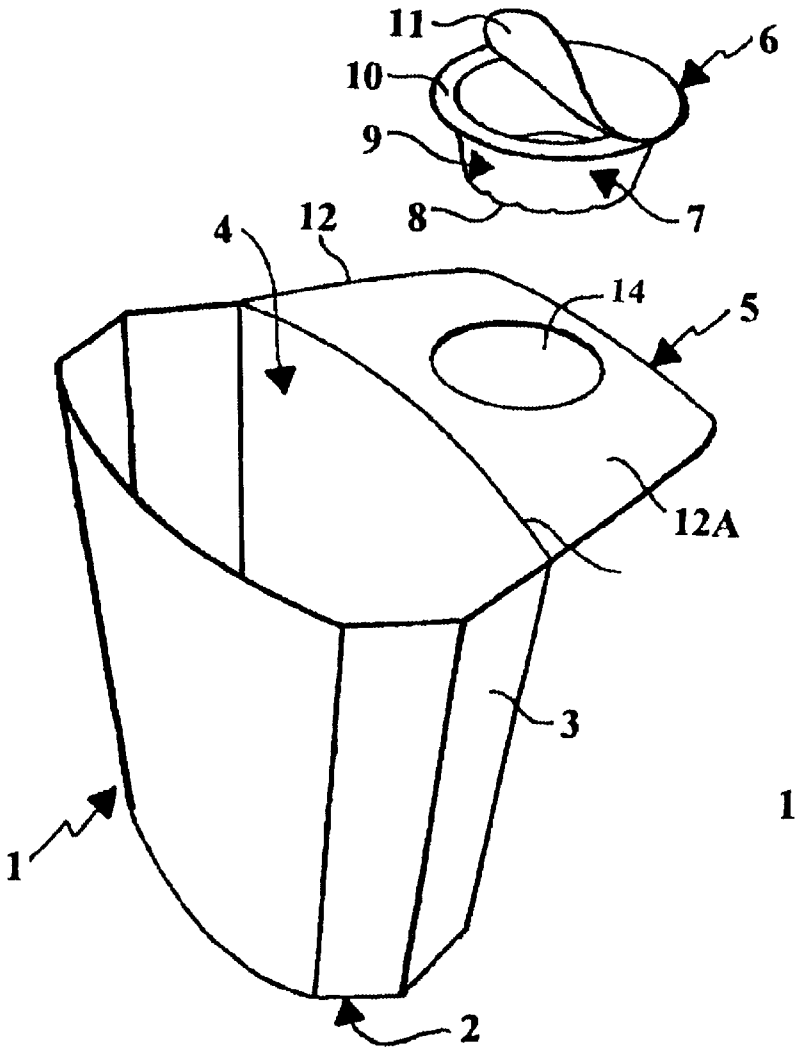
FIG. 1 illustrates, according to a perspective view, a first variant of a set according to the invention.

In terms of the invention, it is convenient to understand by the term "bag" any container sufficiently rigid to receive and support foods, generally solid and individualized, of the type of French fries, fritters, salads, or fresh vegetables, such as boxes, various receptacles, with or without lids.

Classically, such a box 1 consists of a packaging realized starting from a cardboard or carton material or a plastic material, general recyclable. The bag 1 is made of a material that has sufficient rigidity for the required manufacturing constraints and to support the various manipulations to which it will be subjected, while supporting, without excessive deformation, the weight of the foods that it is intended to contain.

The bag 1 consists of a bottom 2 and a peripheral side envelope 3 rising from said bottom 2, to define toward its upper part an orifice 4 that permits introduction of foods and access to the interior of the inner space defined by the bottom 2 and the side envelope 3.

As can be seen in FIGS. 1 through 4 and 6, the space defined by the bottom 2 and the side envelope 3 can have essentially a truncated geometric shape, the bottom 2 being a surface lower than the orifice 4 and, for example, flat, in order to permit the bag to rest in a stable manner on a support plane.

Figure 5:
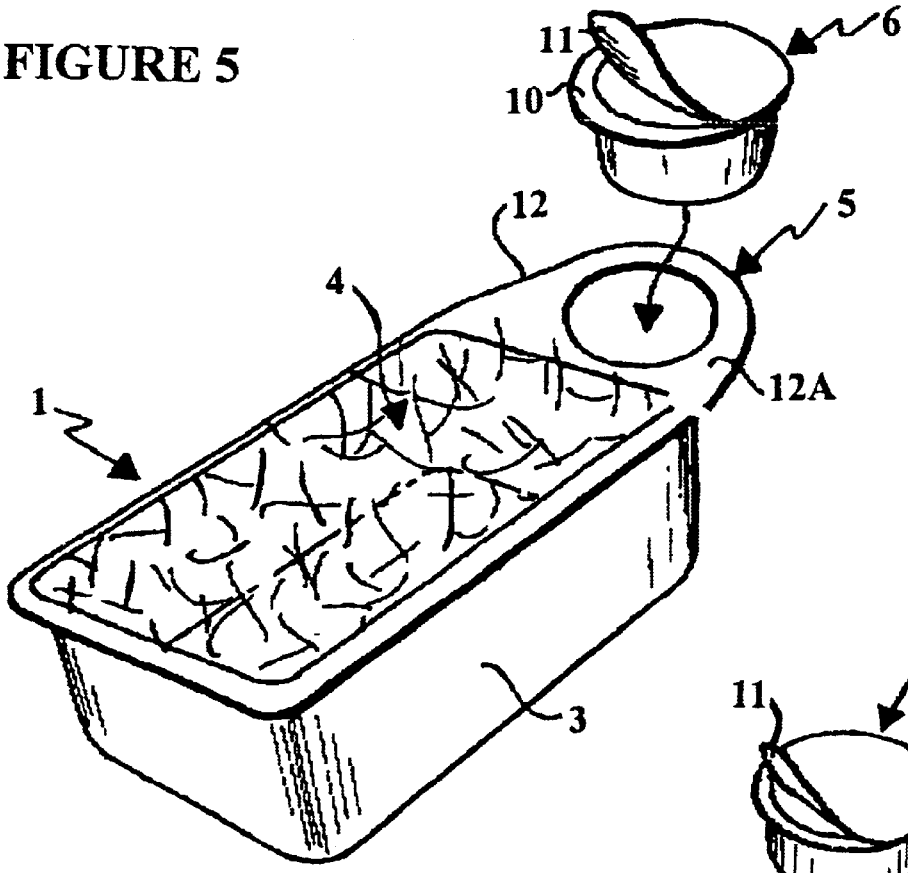
FIG. 5 illustrates a fifth embodiment of the invention.
Figure 7:
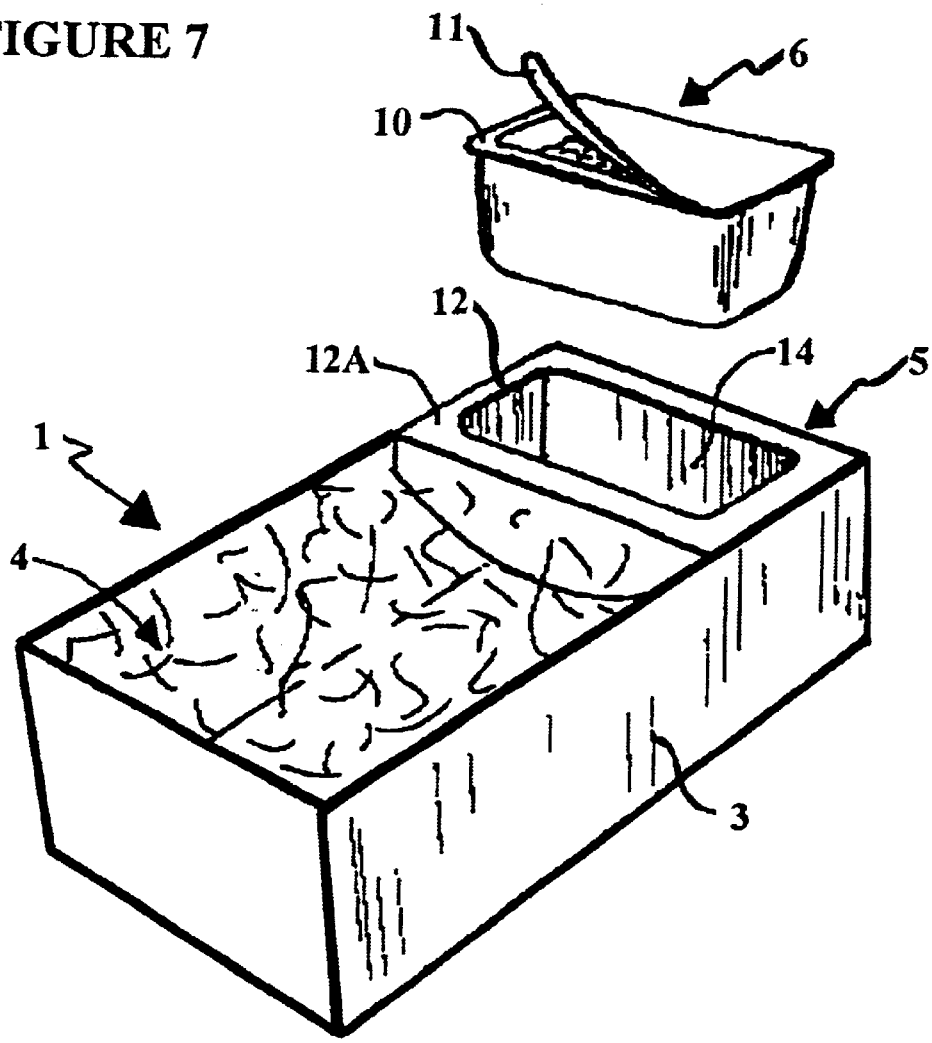
FIG. 7 illustrates a seventh embodiment of the invention.

Without leaving the framework of the invention, it is quite obviously possible to make bags conforming to the invention that have any appropriate geometric shapes other truncated, for example rectangular (FIGS. 5 and 7), square, cylindrical, polygonal, etc.

According to an important characteristics of the invention, the bag 1 includes at least one pre-shaped means of support 5, with an attachment element 14 suitable for receiving and supporting in a stable manner at least one dish 6 intended to contain an accompanying sauce for the food products placed in the bag 1.

The dish 3 consists, in a known manner, of a container 7 that has a bottom 8 and side walls 9 extending upward from the bottom 8 to form in their upper part a peripheral rim 10, directed radially outward, with respect to the axis of symmetry 6 of the dish. The latter is also provided with a closing lid 11 to close the dish 6 tightly and to permit preservation of the sauce or condiment intended to be used as an accompaniment or seasoning for the food products contained in the bag 1.

In terms of the invention, it is convenient to understand by "accompanying sauce" any product capable of be used as an accompaniment or seasoning for food, regardless of the nature or viscosity of the accompanying sauce, which can be presented in liquid, solid, or paste form, for example.

Figure 8:
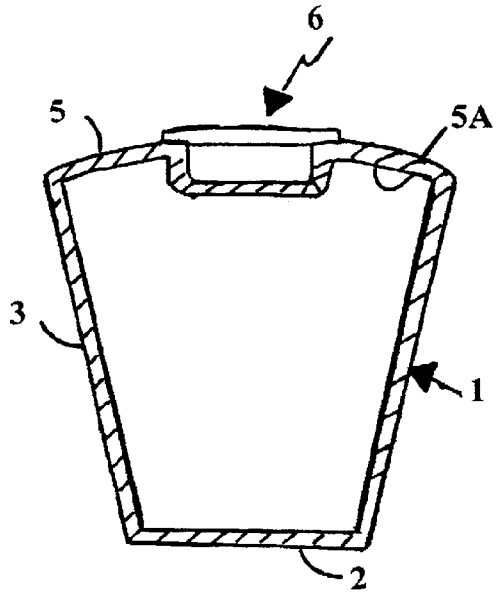
FIG. 8 illustrates a side view (not to scale) of the embodiment of FIG. 7.

According to the invention, the support means 5 consists of a flap 12 attached to the side envelope 3, extending, in its normal position for use, at least partially in the radial direction from the side envelope 3 axis of symmetry of the bag 1, to form a support surface 12A. The flap 12 also includes as an attachment element, for example essentially in its central part, at least one opening 14 intended to receive the dish 6, for which it comes into a support position against and on the support surface by the peripheral 10. The flap 12 can be flat or, preferably, essentially rounded (FIG. 8) to improve stability, forming a concave part 5A turned toward the bottom of the bag, that is the bottom 2.

Figure 6:
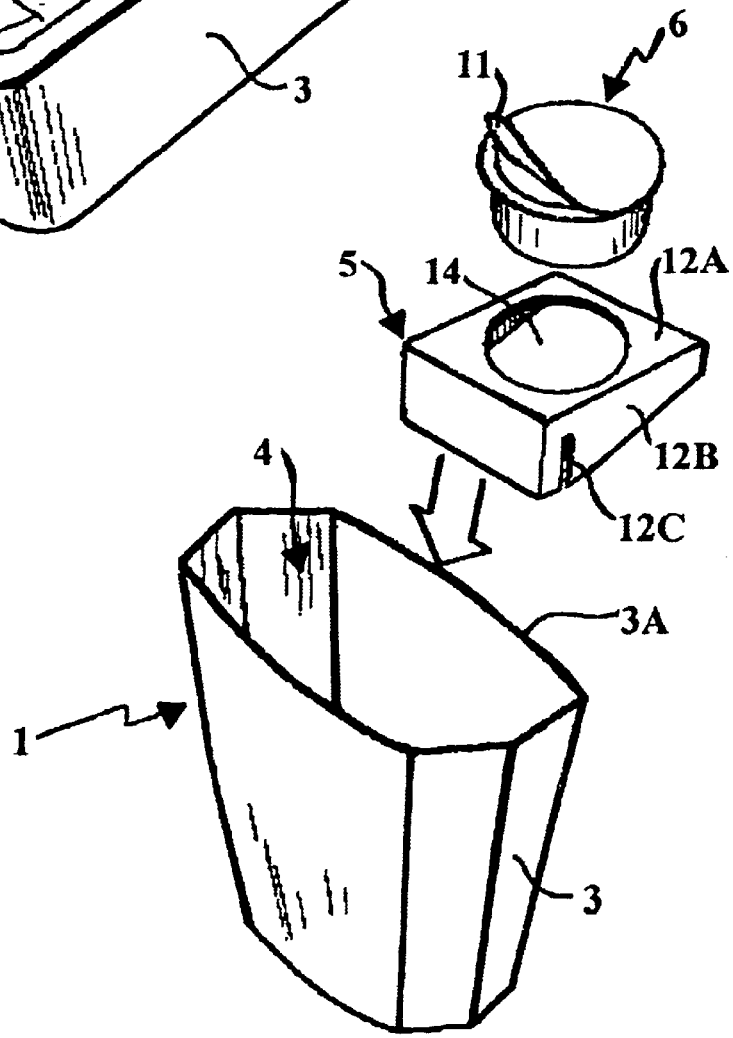
FIG. 6 illustrates a sixth embodiment of the invention.

As a variant, the flap 12 can consist of an element applied to the side envelope 3, thus independent of the bag 1 and attachable to it, as shown in FIG. 6.

According to this variant, the flap 12 can consist of the support surface 12A, for example rectangular or square in shape, the edges of which extend downward in FIG. 6, along sides 12B, preferably butt-jointed. Two incisions 12C are made, aligned with each other, in two opposite sides 12B, in order to permit attachment of the flap 12 to a strip 3A on the side envelope 3, in such a way that the incisions 12C are positioned on either side of the strip 3A. The incisions 12C are sufficiently long to form support means to stabilize the flat 12.

Quite obviously, the size and the dimensions of the dish 6 and in particular the size and dimensions of the bottom 8 and of the side walls 9 are adapted to the size and dimensions of the opening 14, so that the dish 6 can be inserted into the opening 14.

As a variant, it is possible to make a flap 12 provided with several openings 14, each intended to receive a dish 6.

As illustrated in FIG. 1, the dish 6 is generally cylindrical in shape, corresponding to an opening 14 with a symmetrical shape, circular or oval.

Figure 2:
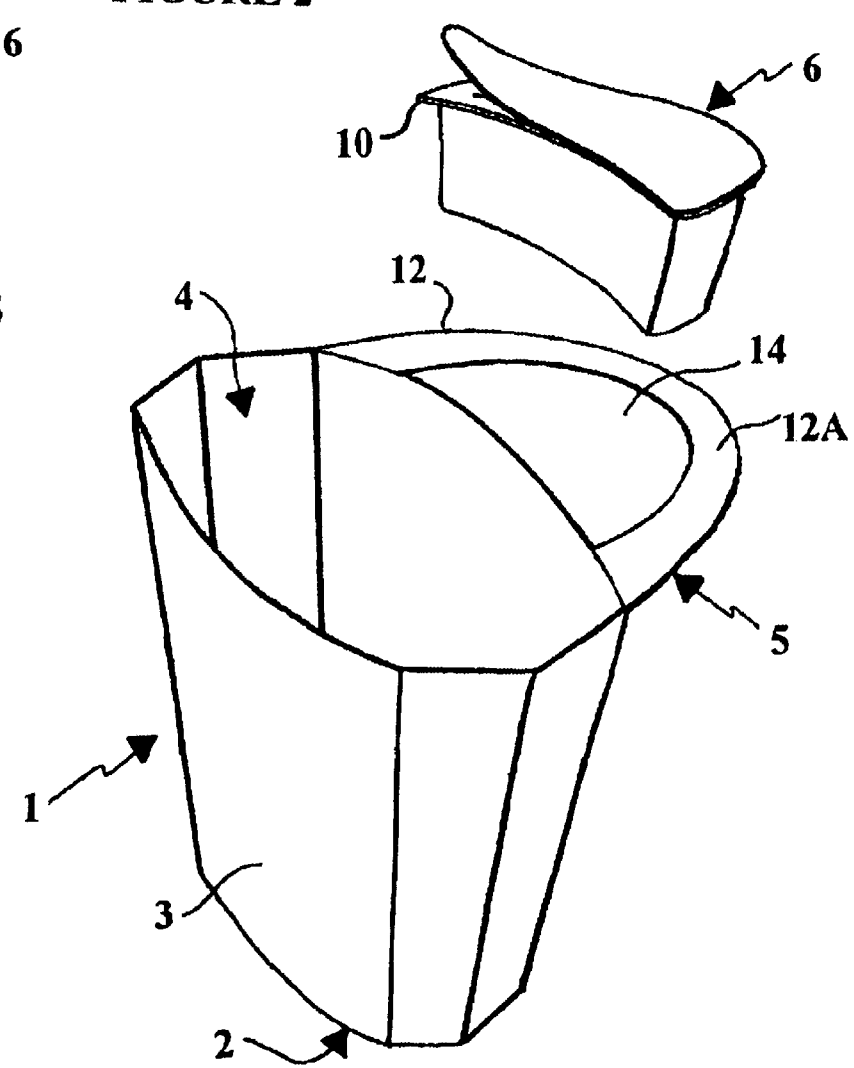
FIG. 2 illustrates, according to a second, preferred embodiment, a set conforming to the invention.

FIG. 2 shows a second embodiment, which differs from that presented in FIG. 1 only in the specific shape of the opening 14 in the shape of a semi-circle, corresponding to a dish 6 with a symmetrical shape, in order to be able to be introduced into the opening 14, supported by the support surface 12A.

According to another characteristics of the invention, the flap 12 extends advantageously in an essentially radial direction at the level of the plane of the orifice 4 corresponding to the upper part of the side envelope 3 and starting from the latter. In this way, the dish 6 is supported directly at the level of the zone where the contents of the bag 1 are held and accessed. It is evidently quite possible, without leaving the framework of the invention, to make the flap 12 at a different level and in another geometric location with respect to the side envelope 3.

According to the invention, the flap 12 can move relative to the side envelope 3 and is connected to the latter by an articulation 15. This feature permits manufacturing of the bag 1 to be simplified by facilitating its cutting, while permitting the user to unfold the bag 1 and to put the dish 6 in place easily.

Advantageously, the flap 12 is of the same material as the envelope 3, so that the bag and the flap 12 form a single mono-block element, without an attachment element.

According to this variant, the flap 12 can extend radially from the side envelope 3 and toward the interior space of the bag 1 above the bottom 2 (FIG. 7) or offset at and toward the outside of the space of the bag 1 (FIGS. 1 through 5).

Figure 3:
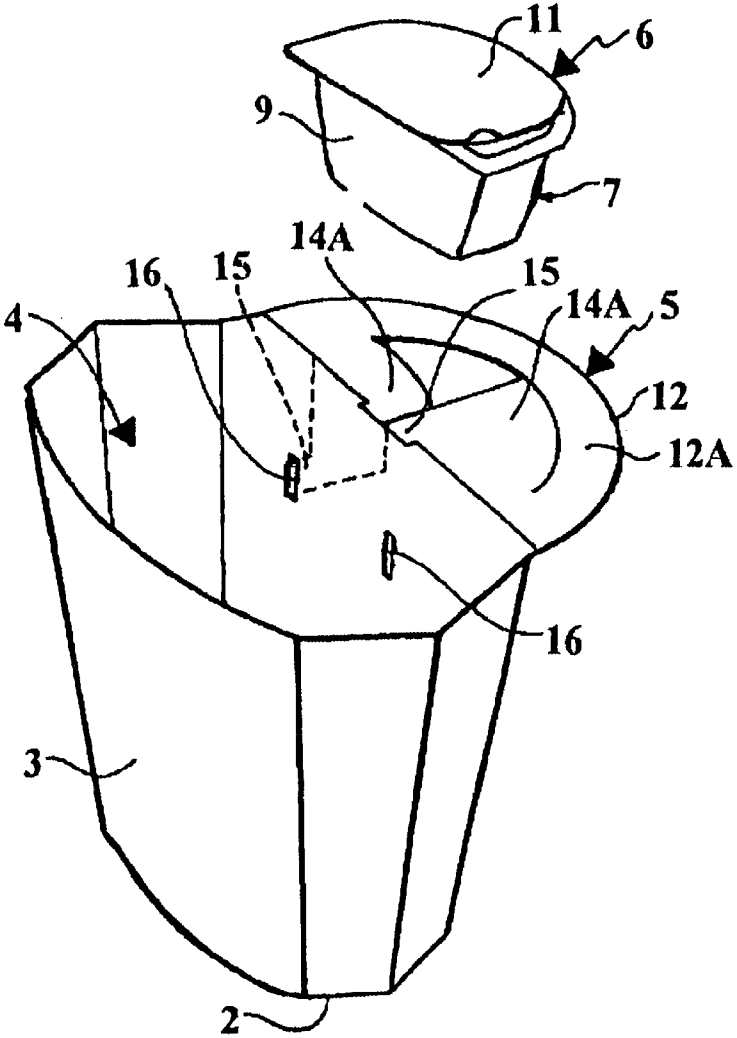
FIG. 3 illustrates, according to a third variant of the invention, a set conforming to the invention.

According to a third embodiment, illustrated in FIG. 3, the opening 14 is formed advantageously by a pre-cut 14A made through the thickness of the flap 12 and forming a partition that can be unfolded and eventually torn off.

According to the particular variant illustrated in FIG. 3, the bag 1 includes means for stabilizing the position of the support means 5 with respect to the side envelope 3.

For this purpose, the stabilization means are attached to and carried by the support means 5, and formed by folding flap elements 12, in this case by the partition 14A, which in the deployed position comes to support the block against the outside of the side envelope 3.

According to the particular variant illustrated in FIG. 3, the partition 14A is made of two half-partitions, corresponding to the opening 14, of which one of the ends 15 in the form of a tab, comes to be inserted into a corresponding slot 16 made through a zone of the side envelope 3 adjacent to the flap 12.

Thus, when the two half-partitions 14A are unfolded and deployed and the ends 15 are locked in the slots 16, the support means 5 are maintained in a stable position and locked with respect to the side envelope 3. In use, the dish 6 is thus supported in a particularly stable manner by the flap 12, since the latter is locked in a stable position and radially in an offset position.

Moreover, thanks to the geometry of the set, the set of the bag 1 and the dish 6 can rest in a stable manner on a support plane, such as a table, for example.

Figure 4:
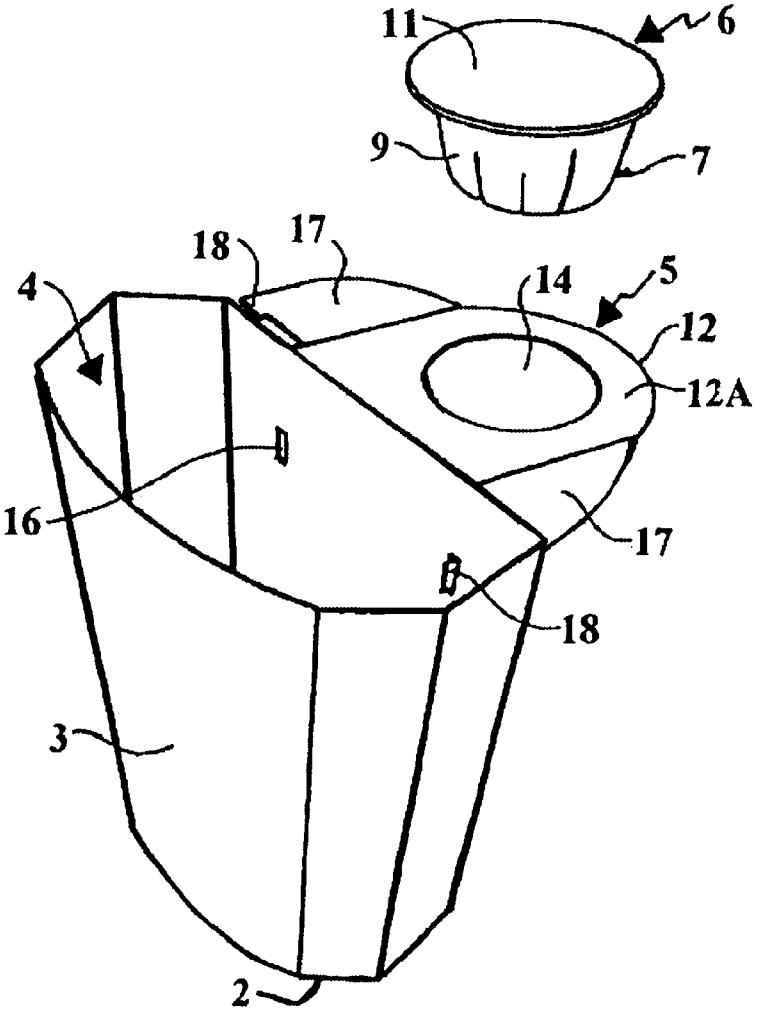
FIG. 4 illustrates a fourth preferred variant of the invention.

FIG. 4 illustrates a fourth embodiment, which differs from that illustrated in FIG. 3 only in a different configuration of the stabilization means.

According to this new embodiment, the folding elements are made of two folding arms 17 that come from one end 18 that form a tab when they are unfolded, in a locking support against the side envelope 3, the table 18 coming to be inserted into the slot 16 made to the right of the flap 12 in the surface of the side envelope 3 adjacent to the opening 14.

According to this new embodiment, the folding elements are made of two folding arms 17 that come from one end 18 that form a tab when they are unfolded, in a locking support against the side envelope 3, the table 18 coming to be inserted into the slot 10 made to the right of the flap 12 in the surface of the side envelope 3 adjacent to the opening 14.

According to this variant, the folding arms 17 extends in the unfolded position correspond to their locking and support position, along an extension plane that is perpendicular to the extension plane of the face of the side envelope 3 under discussion.

According to another embodiment, not shown in the diagrams, the stabilization means can be made directly by the dish itself, that is, by a part of its side envelope 9 that comes to a support position against the side envelope 3 when the dish 6 is inserted into the orifice 4.

The invention likewise concerns a set consisting of a bag 1 conforming to the invention and a dish 6 containing an accompanying sauce, said set being intended to be received and supported by the support means of the bag 1.

The invention consequently has the advantage of providing a bag for fast-food restaurants, the manufacture of which does not require a major transformation of the packaging involved, since the pre-shaped support means can be realized very easily by simple cutting at the time the bag itself is manufactures.

Moreover, realization of this support directly on the bag permits the basic set to be realized from materials that are easily recyclable, which avoids having the necessity of support systems for which recycling is more difficult.

In use, when the user has placed the support means 5 in position, which are eventually locked into position, and has inserted the dish 6 into the opening 14, he can very easily dip the food contained in the bag 1 into the dish 6.

What is claim is:

1. A bag (1) for fast-food restaurants, intended to contain consumable food products, said bag (1) comprising a bottom (2) and a peripheral side envelope (3), which define an orifice (4) in an upper part of the bag, wherein the bag further includes at least one pre-shaped support means (5) with an attachment element to receive and support in a stable manner at least one dish (6) for containing an accompanying sauce for food productions placed in the bag, the support means (5) comprises a flap (12) attached to the side envelope (3) and extending, at least in part, essentially radially, offset at and towards the outside of the space of the bag (1), starting from the side envelope (3) to form a support surface (12A), said flap (12) incorporating an opening (14) for receiving the dish (6), in such a manner that said dish comes into a support position against and on the support surface (12A) along a peripheral rim (10) of the dish, the flap (12) can move with respect to the envelope (3) and is connected to the envelope (3) by an articulation (15), the bag includes means of stabilization (12C, 14A, 17, 18, 15, 6) for the position of the support means (5) with respect to the envelope (3), the stabilization means are attached to the support means (5) and carried by the support means, and the stabilization means comprise a pre-cut (14A) made through the thickness of the flap (12) to form a partition (14A) and the opening (14), and when the partition (14A) is folded to the deployed position, the partition (14A) rests against the side envelope (3) to support the support means.

2. A bag according to claim 1, wherein the pre-shaped support means (5) are suitable for receiving and supporting the dish (6) in a removable manner.

3. A bag according to one of claims 1 through 2, wherein the flap (12) extends essentially radially at the level of the orifice (4).

4. A bag according to claim 3, wherein the flap (12) is of the same material as the envelope (3).

5. A bag according to claim 3, wherein the flap (12) is an element attached to the side envelope (3).

6. A bag according to claim 1, wherein a side envelope (9) of the dish (6) comes into a support position against the side envelope (3) when the dish is inserted into the opening (14).

7. A bag according to claim 1, wherein the stabilization means comprise folding elements (17, 18) of the flap (12), the folding elements comprise two folding arms (17), and respective ends (18) of the folding arms (17) are inserted into respective slots (16) in a side of the side envelope (3), to support locking the folding elements (17, 18) against the side envelope (3).

8. A bag according to claim 1, wherein the bag is made of a plastic material or of cardboard.

9. An assembly comprising a bag according to claim 1 and a dish (6) containing an accompanying sauce, wherein the dish is received and supported by the support means of the bag.

* * * * *